United States Patent [19]

Forrest et al.

[11] Patent Number: 4,919,159

[45] Date of Patent: Apr. 24, 1990

[54] METHOD AND APPARATUS FOR CLEANING THE INTERIOR SURFACES OF BUILDINGS, AND ESPECIALLY CEILINGS OF OFFICE BUILDINGS

[75] Inventors: Robin J. Forrest, Toronto; Russell C. Ward, King City, both of Canada

[73] Assignee: Ceiling Doctor International Inc., Toronto, Canada

[21] Appl. No.: 212,981

[22] Filed: Jun. 29, 1988

[51] Int. Cl.[5] ..... B08B 3/00

[52] U.S. Cl. ..... 134/22.18; 134/22.12; 134/32; 134/37

[58] Field of Search ..... 134/22.12, 22.18, 22.19, 134/22.15, 37, 32

[56] References Cited

U.S. PATENT DOCUMENTS

| | | | |
|---|---|---|---|
| 1,047,791 | 12/1912 | Gregg | 134/22.12 |
| 1,544,509 | 6/1925 | Vowell | 134/22.12 |
| 1,750,609 | 3/1930 | Turke | 134/22.12 |
| 1,759,920 | 5/1930 | Talbott | 134/22.12 |
| 2,022,481 | 11/1935 | Schellenger | 137/78 |
| 2,077,257 | 4/1937 | Ofeldt | 299/84 |
| 2,381,649 | 8/1945 | Dalton | 299/42 |
| 2,692,798 | 10/1954 | Hicks | 299/58 |
| 2,757,800 | 8/1956 | Kucera | 210/152 |
| 3,037,707 | 6/1962 | Ligon | 239/310 |
| 3,147,922 | 9/1964 | Warner | 239/127 |
| 3,168,247 | 2/1965 | Schild | 239/127 |
| 3,188,238 | 6/1965 | Lyon | 134/22.18 |
| 3,410,724 | 11/1968 | Kondrot | 134/31 |
| 3,544,366 | 12/1970 | Uhlmann | 134/31 |
| 3,816,025 | 6/1974 | O'Neill | 417/9 |
| 3,833,417 | 9/1974 | Griparis | 134/22.18 |
| 3,958,724 | 9/1974 | Ordway | 222/318 |

*Primary Examiner*—Asok Pal

*Attorney, Agent, or Firm*—Sughrue, Mion, Zinn, Macpeak & Seas

[57] ABSTRACT

A method and apparatus for cleaning the interior surfaces of buildings, especially the ceilings of office buildings, involves producing a fine mist of cleaning liquid which is sprayed onto said surfaces. This fine mist is produced by pumping a cleaning liquid from a container by means of a pump which leads to a delivery tube and which produces a pressure of at least 300 psi, the liquid being atomized by a nozzle having a breadth less than 0.020 inches. The amount of liquid passing through the pump is more than 5 times the amount passing through the nozzle, and the remainder of this liquid is returned by a bypass line to the container.

3 Claims, 1 Drawing Sheet

METHOD AND APPARATUS FOR CLEANING THE INTERIOR SURFACES OF BUILDINGS, AND ESPECIALLY CEILINGS OF OFFICE BUILDINGS

The present invention provides a method and apparatus for cleaning the interior surfaces of buildings, and especially ceilings of office buildings.

One known method for cleaning the ceiling of a building is to spray a cleaning solution, usually including detergent and water, onto the ceiling by means of a pump and spray gun. Usually, the pressure used is around 40 psi to 60 psi, which produces relatively large droplets on the ceiling which gives rise to problems of dripping. The relatively small amounts of liquid which need to be applied to a ceiling, being of the order of 1 gallon per hour, have dictated the use of rather small pumps of the kind which do not produce high pressures.

I have discovered that much more effective cleaning of ceilings and such interior surfaces can be achieved with very little dripping, by using a fine mist of small droplets. Such droplets can be produced by using high pressures, for example at least 300 psi and preferably over 750 psi, in association with nozzles having a small orifice of less than 0.2 inches in breadth. The use of high pressure requires pumps which pump much more than 1 gallon per hour, but in accordance with a further feature of the invention a large part of the liquid which is pumped passes through a bypass valve and a bypass line back to the liquid container. Generally, the amount of liquid which is pumped is more than 5 times the amount passing through the spray gun nozzle, the remainder being returned to the container via the bypass line.

Further in accordance with the invention, apparatus for cleaning the interior surfaces of buildings, comprises:

a high pressure pump capable of pumping liquid from a container at atmospheric pressure to an outlet at a pressure of at least 300 psi, with means for driving said pump;

a spray gun suitable for manual handling and having a spray nozzle orifice with a breadth of less than 0.02 inches;

a delivery tube connecting said pump outlet to said spray gun to allow liquid pumped from the container to pass through the nozzle;

a bypass tube allowing liquid to pass from said pump outlet back to said container; and a valve controlling flow of liquid from said pump outlet to said bypass tube;

said valve and bypass tube being arranged, according to the capacity of the pump and the orifice size, so that at least 80% of the liquid pumped by the pump is returned to the container via the bypass line.

The invention will now be described with reference to the accompanying drawing, which shows diagramatically a preferred apparatus in accordance with the present invention.

BRIEF DESCRIPTION OF DRAWING

The apparatus comprises, essentially, a container 1 for the cleaning liquid, a liquid pumping unit 2, and a spray gun 3.

Container 1 has a capacity of about 1 gallon of cleaning liquid and provides for about 1 hour of operation. Cleaning liquids used are various formulations of water with detergents, caustic soda, and/or bleaching agents. A preferred solution which gives good results is a mixture of 1 part detergent liquid and one part bleach liquid to 24 parts water. The bleach liquid is a 12% solution of sodium hypochlorite in water (eg. 12 gm/100 cc). The preferred detergent liquid is a solution in water containing less than 1% each of nonionic detergent and a phosphate, and less than 2% of 2-butoxy ethanol.

Figure 1:
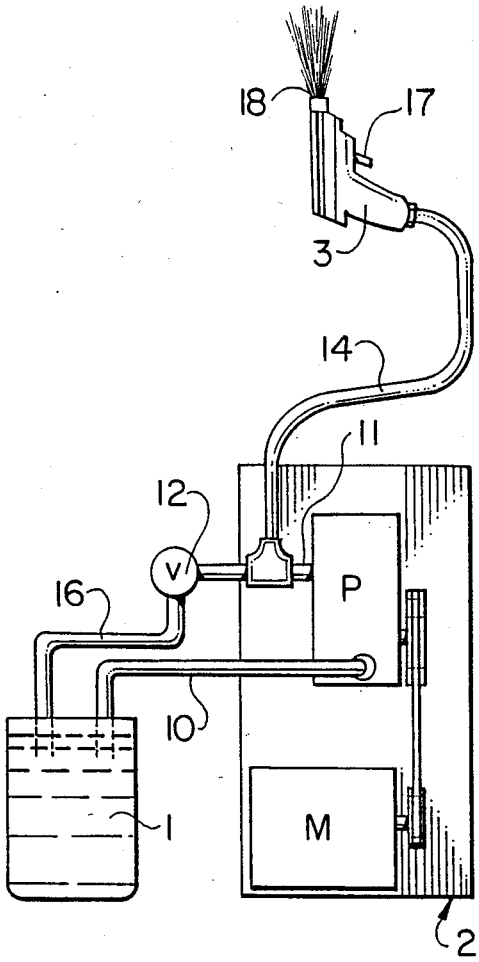

A suction tube 10 leads from the container 1 to pump P of the pumping unit 2, this being belt driven by electric motor M. Pump P is a high pressure reciprocating pump of the general type shown in U.S. Pat. Nos. 3,809,508 which issued May 7, 1974 to Maruyama Mfg. Co. Ltd. and 3,930,756 which issued Jan. 6, 1976 to Cat Pumps Corporation of Minneapolis, Minn., U.S.A. The preferred model is one designated Number 282,110 produced by Cat Pumps Corporation, and having a capacity of about 1 gallon per minute.

The outlet 11 from pump P goes to a pressure regulating valve 12, preferably a model 6548LAY Hoche valve made by Hoche Controls of New Jersey, U.S.A. This arranged to allow flow of liquid into a delivery tube 14 leading to the spray gun 3, but when the pressure at the spray gun is higher than a certain setting, say 500 psi and in any event higher than 300 psi, a bypass port in the valve opens and allows liquid to flow through the bypass line 16 back to the container 1. The valve thus serves to maintain a pressure of about 500 psi in the delivery tube 14, since the capacity of the pump P is much higher than the throughput of the spray gun. A pressure gauge may be provided to check this pressure. The spray gun 3 has a trigger 17 which controls flow of the liquid to a nozzle 18; as shown in the drawing the spray gun 3 can be used to direct the spray upwardly onto a ceiling. Nozzle 18 has a small oval orifice which is interchangeable according to the particular requirements of the cleaning procedure. The orifices used produce a fan-type spray of 50° or 65° included angle, and the orifices are sized so that their breadth (ie. the minor cross-sectional dimension of the oval shaped opening) is always less than 0.020 inches. For example, orifices with a breadth of 0.011, 0.013, 0.015, and 0.018 may be used. The largest of these orifices has a throughput of 0.18 gallons per minute when supplied at 500 psi pressure. Since the pump is delivering 1 gallon per minute, over 80% of the liquid which is pumped continuously is recycled through the valve 12 and the bypass line 16 back to the container. In other words, the amount of liquid being pumped is more than 5 times the amount which passes through the spray gun nozzle. For smaller orifices, the amount being pumped may be more than 10 times the amount passing through the nozzle. By this means, it is possible to use a high pressure pump even for delivering only a small amount of liquid to the spray gun. Pressures of over 1,000 psi and up to 3,000 psi may be used. The fine atomization which is achieved produces good cleaning with very little dripping. The fine droplets serve to dissolve grease and to neutralize static electricity which tends to hold dirt onto ceilings, the dirt drops in substantially dry form and can be removed by vacuum cleaners.

The embodiments of the invention in which an exclusive property or privilege is claimed are defined as follows:

1. A process for cleaning the interior surfaces of buildings including office ceilings, wherein a fine mist of cleaning liquid droplets is sprayed into said surfaces, said fine mist being produced by pumping said liquid from a container by means of a pump which leads to a delivery tube and which produces a pressure of at least 300 psi, and atomizing said liquid by means of a spray gun having a nozzle with an oval-shaped orifice having a breadth less than 0.020 inches and which produces a fan-type spray, said fan-type spray being capable of being directed by the spray gun upwardly onto ceiling surfaces, the relationship of pressure to nozzle size being such that the amount of liquid which passes through the nozzle is less than 0.20 gall/minute, wherein the amount of liquid passing through the pump is more than 5 times the amount passing through the nozzle with the remainder of the liquid being continuously returned via a bypass line to said container, the amount of liquid being sprayed and the fineness of the droplets being produced being such that very little dripping occurs.

2. A process according to claim 1, wherein said pressure is at least 750 psi.

3. A process according to claim 1 or claim 2, wherein the quantity of liquid being pumped is more than 10 times the amount which passes through said nozzle, the amount passing through the nozzle being less than 0.10 gall/minute.

* * * * *